United States Patent [19]

Ogita

[11] 4,432,316

[45] Feb. 21, 1984

[54] COLD HC EMISSION CONTROLLING DEVICE FOR AUTOMOBILE EQUIPPED WITH CATALYST TYPE DISPOSAL SYSTEM

[75] Inventor: Tamotsu Ogita, Shizuoka, Japan

[73] Assignee: Toyota Jidosha Kogyo Kabushiki Kaisha, Aichi, Japan

[21] Appl. No.: 302,051

[22] Filed: Sep. 14, 1981

Related U.S. Application Data

[63] Continuation of Ser. No. 49,988, Jun. 19, 1979, abandoned.

[30] Foreign Application Priority Data

Jul. 10, 1978 [JP] Japan ..... 53-83007

[51] Int. Cl.[3] ..... F02D 31/00

[52] U.S. Cl. ..... 123/328; 123/327

[58] Field of Search ..... 123/DIG. 11, 328, 327, 123/407

[56] References Cited

U.S. PATENT DOCUMENTS 3,301,242 1/1967 Candelise ..... 123/407
3,612,018 10/1971 Soberski ..... 123/407
3,631,845 1/1972 Walker ..... 123/407
4,059,088 11/1977 Tateno ..... 123/DIG. 11
4,060,063 11/1977 Hirasawa ..... 123/328
4,168,681 9/1979 Kawai ..... 123/DIG. 11
4,178,890 12/1979 Yamabe ..... 123/327

*Primary Examiner*—Ronald B. Cox
*Attorney, Agent, or Firm*—Browdy and Neimark

[57] ABSTRACT

A HC emission controlling apparatus for use in an automobile is equipped with a catalytic type emission disposal converter (system) as an anti-pollution measure, having a deceleration emission controlling device such as a dash pot engageable with the throttle valve lever and connected to a vacuum control device. The apparatus includes a deceleration emission controlling device connected through a vacuum-transmitted valve to the vacuum controlling device, the vacuum controlling device being provided with a change-over valve which is adapted to be actuated by a temperature-sensitive actuating member. The change-over valve brings the vacuum-transmitted valve into communication with the atmosphere and with a vacuum source, respectively, before and after the warming up of the engine.

5 Claims, 1 Drawing Figure

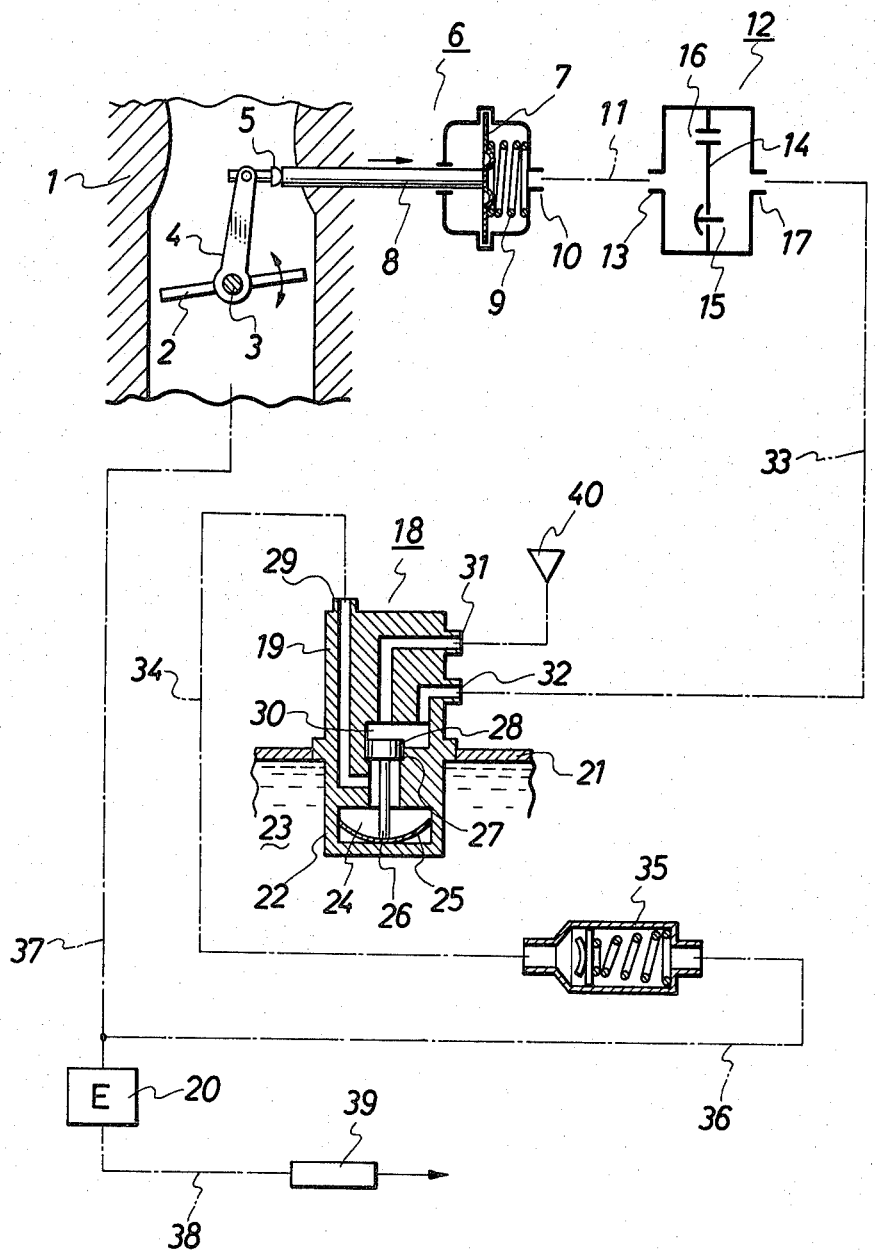
1
2
3
4
5
6
7
8
9
10
11
12
13
14
15
16
17
18
19
20
21
22
23
24
25
26
27
28
29
30
31
32
33
34
35
36
37
38
39
40
E

COLD HC EMISSION CONTROLLING DEVICE FOR AUTOMOBILE EQUIPPED WITH CATALYST TYPE DISPOSAL SYSTEM

This is a continuation of application Ser. No. 049,988 filed June 19, 1979 now abandoned.

BACKGROUND OF THE INVENTION

The present invention relates to a cold HC emission controlling device for use in automobiles equipped with a catalytic type disposal system.

It is well known that automobiles are equipped with so-called catalytic type disposal system as a measure for reducing the emission of noxious exhaust emmissions, particularly for reducing total HC during the engine operation.

However, this system has a drawback that the desired activity of the catalyst is not obtained until the catalyst temperature is raised to a predetermined level by the exhaust gas. To obviate this problem, various countermeasures have been proposed. One of the proposed techniques is to generate unburnt substances at the time of cold start after an engine-off period to promote a rise of the temperature of the catalyst. These countermeasures, however, have not been successful.

It is also known to provide a so-called deceleration emission controlling device having a dash pot or throttle positioner for controlling the total HC emission at the time of deceleration or gear shifting. This controlling device also has a drawback that it inconveniently increases the rate of fuel consumption. In addition, the drivability of the engine is liable to be deteriorated. For instance, engine braking is rendered less effective.

SUMMARY OF THE INVENTION

It is an object of the present invention to provide, in view of the problem concerning HC control by the above-noted conventional deceleration emission controlling devices, an HC emission control device for use in automobiles having a catalytic type disposal system, the deceleration emission controlling device being associated with a vacuum control device to effect the HC emission control only during the cold operation period of the engine during which the catalyst has not been fully activated.

Another object of the present invention is to provide a cold HC emission control device in which HC emission is totally reduced by the catalytic type disposal system, after the engine has been warmed up, to minimize the increase of the fuel consumption rate.

BRIEF DESCRIPTION OF DRAWING

The above-mentioned objects of the invention, as well as others, are achieved by the cold HC emission controlling device of the invention which has the features and characteristics set out below. Namely, in the cold state of the engine, a temperature sensitive actuating member of a vacuum control device switches a change-over valve to the low-temperature side to bring a vacuum-transmitted valve into communication with atmosphere to make the deceleration emission control device operative to bring a delay rod into contact with the throttle valve during deceleration and gear shifting to prevent quick closing of the throttle valve thereby to reduce the HC emission. On the other hand, after the engine has been warmed up, the temperature responsive actuating member actuates the change-over valve to make the vacuum-transmitted valve communicate with the vacuum side to keep the delaying rod of the deceleration emission control device away from the throttle valve to allow a quick closing of the latter so that the HC disposal of the exhaust emission is conducted by the activated catalyst.

Referring to the sole FIGURE of the accompanying drawing, a reference numeral 1 denotes the venturi portion of a carburetor mounted on an automobile. The venturi portion 1 includes a throttle valve 2 supported by a shaft 3 to which attached is a throttle lever 4 provided at its other end with a pin 5.

A dash pot 6, which constitutes a known deceleration emission controlling device is provided. The dash pot 6 has a diaphragm 7 to which a delay rod 8 is attached. The arrangement is such that the free end of the delay rod 8 comes into contact with the end of the pin 5, when the throttle valve 2 has been closed to a predetermined opening angle which is greater than the angle corresponding to the full closing of the throttle valve, while the engine is in the cold state.

The dash pot 6 has a port 10 located at the same side as a biasing spring 9 from the diaphragm 7. The port 10 is in fluid communication with a port 13 of a front chamber of a vacuum-transmitted valve 12, via a conduit or pipe 11.

The vacuum-transmitted valve 12 has a diaphragm 14 provided with a check valve 15 and an orifice 16, while the rear chamber is provided with a port 17.

A reference numeral 18 denotes a bimetal vacuum switching valve which serves as the vacuum control device. This bimetal vacuum switching valve has a casing 19 screwed into a jacket 21 of an engine 20, shown diagrammatically, with its temperature sensing end 22 immersed in cooling water 23.

The temperature sensing end 22 has a bore 24 in which disposed is a bimetal constituting the temperature sensitive actuating member. A bimetal member 25 is connected to a change over valve 28 adapted for cooperation with a seat 27. The bore 24 is in fluid communication with a vacuum port 29. A bore 30 above the seat 27 is in fluid communication with an atmospheric port 31 and an actuating port 32. The arrangement is such that the actuating port 32 is selectively brought into communication with the atmospheric port 31 and the vacuum port 29, depending on the position of the change-over valve 28. The actuating port 32 is communicated with the port 17 of a rear chamber of the vacuum-transmitted valve 12, via a pipe 33.

On the other hand, the vacuum port 29 is communicated with a check valve 35 by means of a pipe 34. The check valve 35 is connected to an intake manifold 37 of the engine 20 through a pipe 36.

An exhaust manifold 38 is connected to a known catalytic type disposal converter (system) 39 which is provided in the exhaust gas pipe. An air cleaner 40 is disposed in the atmospheric port 31 of the bimetal vacuum switching valve 18.

In operation, when the automobile engine 20 is cold started after a long engine-off period, the bimetal member 25 is not actuated because the temperature of the cooling water in the jacket 21 is still low. Therefore, the change-over valve 28 is seated on the seat 27 as illustrated so that the vacuum derived from the intake manifold 37 through the vacuum port 29 is cut at the bore 24, while the atmospheric port 31 is communicated with the actuating port 32 through the bore 30. Consequently, the vacuum-transmitted valve 12 is communicated with the atmosphere.

As the engine is decelerated or as the gears are shifted in this condition, the dash pot 6 operates in a conventional fashion. Namely, the throttle valve 2 is prevented from being fully closed abruptly because the pin 5 on the lever 4 abuts the delaying rod 8 to press the diaphragm 7. The throttle valve 2 is then fully closed with a certain delay which is determined by various factors such as elastic modulus of the biasing spring 9 and flow characteristics through the check valve 15 and the orifice 16. As a result, the HC emission is controlled during deceleration and gear shifting.

During this period, the catalytic converter 39 has not been heated and, therefore, is not activated sufficiently. However, the total HC emission is effectively reduced by the above-described function of the deceleration emission controlling device.

The temperature of the cooling water 23 in the jacket 21 is gradually increased after the start of the engine and reaches a temperature equal to the temperature at which the catalyst 39 is activated. Then, the bimetal member 25 which has been adjusted to operate at that temperature operates to move the rod 26 which in turn drives the change-over valve 28 upwardly in the bore 30 away from the seat 27. Consequently, the atmospheric port 31 is closed, and the actuating port 32 is made to open to the lower bore 24 to communicate with the vacuum port 29. As a result, the vacuum-transmitted valve 12 is subjected to the vacuum derived from the intake manifold 37, through the pipe 33, bimetal vacuum switching valve 18, pipe 34 and the check valve 35.

Needless to say, it is designed such that the upward driving force of the bimetal member 25 is greater than the force of the vacuum exerted on the change-over valve 28 via the vacuum port 29 and the bore 24, so that the upward movement of the change-over valve 28 may be made smoothly.

After the engine has been warmed up, the check valve 15 of the vacuum-transmitted valve 12 is closed by the vacuum derived from the intake manifold 37. Due to the flow characteristic across the orifice 16, the diaphragm 16 always pulls the diaphragm 7 of the dash pot 6, through the pipe 11, against the force of the biasing spring 9. As a result, the delay rod 8 is retracted to take the position away from the pin 5 even at the time of deceleration and gear shifting so as to allow the throttle valve 2 to be fully closed quickly. The HC in the exhaust emission is therefore treated totally by the activated catalytic converter 39. Also, the increase of fuel consumption attributable to the delay of the full closing of the throttle valve 2 is conveniently avoided.

Consequently, the HC emission is totally reduced over the entire mode of engine operation before and after the warming up, and the increase of the fuel consumption is conveniently minimized.

The described embodiment is not exclusive. For instance, a throttle positioner which is also known as a deceleration emission controlling device may be used in place of the dash pot.

As has been described, according to the invention, there is provided a cold HC emission control device for use in automobiles having a catalyst type disposal system, having the following features. Namely, in the cold HC emission control device of the invention, a vacuum control device is connected to a deceleration emission controlling device provided with a delaying rod engageable with the throttle valve of the engine, through a vacuum-transmitted valve. The vacuum control device is provided with a change-over valve which is adapted to bring the vacuum-transmitted valve into communication with the vacuum side and the atmospheric side selectively, the change-over valve being operatively connected to a temperature sensitive actuating member. The temperature sensing member is adapted to make the vacuum-transmitted valve communicate with the atmosphere only in the cold state of the engine. Therefore, the deceleration emission control device such as dash pot is allowed to operate to effect the control of HC emission during deceleration of the engine and during the gear shifting. On the other hand, after the engine has been warmed up, the vacuum-transmitted valve is communicated with the vacuum side, so as to keep the delaying rod of the deceleration emission control device away from the throttle valve lever to allow the throttle valve to be fully closed quickly even during deceleration and gear shifting. Consequently, the increase of the fuel consumption rate is reduced, and the engine brake is rendered more effective to improve the drivability. After the warming up of the engine, the HC emission is effectively controlled by the catalytic converter which has been sufficiently heated and activated. Therefore, the HC emission is totally treated over the entire mode of engine operation before and after the warming up.

What is claimed is:

1. A cold HC emission controlling apparatus for use in an automobile equipped with a catalytic type disposal system, the apparatus comprising a deceleration emission control device having a delaying rod positioned to be moved into and out of engagement with a throttle valve lever in a carburetor of an engine of the automobile, a vacuum control device for operating said deceleration emission control device through a vacuum-transmitting valve; whereby said vacuum-transmitting valve operates said decelerating emission control device; said vacuum control device comprising a bimetal temperature sensitive actuating member and a change-over valve operatively connected to said bimetal member for moving from said vacuum transmitting valve from a position in which said vacuum control device is put in communication with a vacuum source to a position in which said vacuum control device is put in communication with the atmosphere both in said vacuum-transmitting valve, means to locate at least that portion of said vacuum transmitting valve housing said bimetal member directly in the coolant flow stream in the cooling water jacket of the engine, and a vacuum check valve positioned between said vacuum source and said vacuum-transmitting valve.

2. A cold HC emission controlling apparatus as claimed in claim 1, wherein said deceleration emission control device is constituted by a dash pot.

3. A cold HC emission controlling apparatus as claimed in claim 1, wherein said deceleration emission control device is constituted by a throttle positioner.

4. A cold HC emission controlling apparatus as claimed in claim 1, wherein said vacuum source is an intake manifold of the engine.

5. A cold HC emission controlling apparatus as claimed in claim 1, wherein said atmospheric side is communicated with via an air cleaner.

* * * * *